US006862419B2

(12) United States Patent
Cho et al.

(10) Patent No.: US 6,862,419 B2
(45) Date of Patent: Mar. 1, 2005

(54) LIQUID IMAGE DEVELOPING SYSTEM HAVING DEVELOPMENT ROLLER PARTIALLY SOAKED IN DEVELOPER

(75) Inventors: Jun-hee Cho, Gyeonggi-do (KR); Yong-su Kim, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/245,564

(22) Filed: Sep. 18, 2002

(65) Prior Publication Data

US 2003/0138271 A1 Jul. 24, 2003

(30) Foreign Application Priority Data

Jan. 22, 2002 (KR) ..... 2002-3701

(51) Int. Cl.[7] ..... G03G 15/10

(52) U.S. Cl. ..... 399/237; 399/238; 399/240

(58) Field of Search ..... 399/237, 238, 399/239, 240, 233, 235, 247, 248; 366/169.1, 169.2, 170.3; 430/117

(56) References Cited

U.S. PATENT DOCUMENTS

| | | | | | |
|---|---|---|---|---|---|
| RE16,314 | E | * | 4/1926 | Kenney | 52/508 |
| 4,021,586 | A | * | 5/1977 | Matkan | 399/237 |
| 4,299,902 | A | * | 11/1981 | Soma et al. | 399/248 |
| 4,860,050 | A | * | 8/1989 | Kurotori et al. | 399/238 |
| 5,208,637 | A | * | 5/1993 | Landa | 399/238 |
| 5,255,058 | A | | 10/1993 | Pinhas et al. | |
| 5,436,706 | A | * | 7/1995 | Landa et al. | 399/238 |
| 5,488,466 | A | * | 1/1996 | Abreu | 399/240 |
| 5,666,615 | A | * | 9/1997 | Nguyen | 399/240 |
| 6,088,560 | A | * | 7/2000 | Zenk et al. | 399/237 |
| 6,108,506 | A | * | 8/2000 | Umetani | 399/237 |
| 6,122,471 | A | * | 9/2000 | Liu et al. | 399/237 |
| 6,208,822 | B1 | * | 3/2001 | Kitoba et al. | 399/237 |
| 6,311,035 | B1 | * | 10/2001 | Liu et al. | 399/240 |
| 6,488,401 | B1 | * | 12/2002 | Seaman | 366/169.1 |
| 2003/0044202 | A1 | * | 3/2003 | Song et al. | 399/238 |

FOREIGN PATENT DOCUMENTS

JP 63074083 A * 4/1988 ..... G03G/15/10

OTHER PUBLICATIONS

Translation of Horino et al. (JP 63–074083).*

* cited by examiner

*Primary Examiner*—Arthur T. Grimley
*Assistant Examiner*—Ryan Gleitz
(74) *Attorney, Agent, or Firm*—Staas & Halsey LLP

(57) ABSTRACT

A liquid image developing system, including a cartridge in which a developer is stored; a supply line; a development container to which the developer is supplied from the cartridge through the supply line; a photosensitive body in the development container; a development roller partially soaked in the developer in the development container and rotating opposite to the photosensitive body; a depositing member to create a potential difference required to attach the developer to a circumference of the development roller, opposite to the development roller; a metering blade to scratch the developer attached to the circumference of the development roller to a predetermined thickness; and an agitator to agitate the developer contained in the development container. Accordingly, a high-concentration developer can be directly used in the development operation without a dilution operation, and thus the structure to supply the developer can be considerably simplified.

14 Claims, 4 Drawing Sheets

LIQUID IMAGE DEVELOPING SYSTEM HAVING DEVELOPMENT ROLLER PARTIALLY SOAKED IN DEVELOPER

CROSS-REFERENCE TO RELATED APPLICATIONS

This application claims the benefit of Korean Application No. 2002-3701,filed Jan. 22, 2002, in the Korean Industrial Property Office, the disclosure of which is incorporated herein by reference.

BACKGROUND OF THE INVENTION

1. Field of the Invention

The present invention relates to a liquid image developing system, and more particularly, to a liquid image developing system having a simplified structure using a high-concentration developer.

2. Description of the Related Art

In general, liquid image developing systems form an electrostatic latent image corresponding to a desired image by scanning light on a photosensitive body, developing the electrostatic latent image using a developer in which powder-shaped toner is mixed with a liquid solvent, and printing the developed electrostatic latent image on a paper.

FIG. 1 is an example of a conventional image developing system, disclosed in U.S. Pat. No. 5,255,058. As shown in FIG. 1, the conventional image developing system includes a photoconductive drum 10 charged at a predetermined voltage by a photoconductor charging apparatus 14, and an imaging apparatus 16 (i.e., a laser scanning apparatus) to form an electrostatic latent image of a desired image by scanning light onto the charged photoconductive drum 10 and creating a relative voltage difference. The image developing system also includes a developer supplying unit to develop the electrostatic latent image by supplying a developer to the photoconductive drum 10, and an intermediate transfer member 30 to transfer the developed image onto the photoconductive drum 10 and printing the transferred image onto a paper 72.

The developer supplying unit prepares the developer with a toner concentration of less than 3% solid and supplies the developer between the photoconductive drum 10 and a development roller 38. For this purpose, the developer supplying unit includes concentration cartridges 82 and 84 containing a concentrated developer with a toner concentration of 25% solid, a solvent cartridge 86 containing pure solvent, and toner reservoirs 55, 57, 59, and 61 to mix the concentrated developer from the concentration cartridges 82 and 84 with the solvent from the solvent cartridge 86 and preparing a developer with a uniform concentration of about 2–3% solid. The developer supplying unit further includes a multicolor liquid developer spray assembly 20 to pump the developing solvent prepared in the toner reservoirs 55, 57, 59, and 61 to pumps 90, 92, 94, and 96, respectively, and to supply the developer to the development roller 38, and a collecting unit to collect excess developer left after the electrostatic latent image is developed. In addition, the collecting unit includes a collection container 50 to collect the developer supplied between the development roller 38 and the photoconductive drum 10 and to return the developer to the toner reservoirs 55, 57, 59, and 61 for each color, and a squeeze roller 26 to press the photoconductive drum 10 on which the image is developed, and to squeeze the solvent contained in the developed image. The collecting unit further includes a separator 66 to collect the squeezed developer through the collection container 50, to separate color toner from the collection container 50 and to return the solvent to a solvent reservoir 65.

In the above structure, in order to perform a development step, a developer having four colors, such as yellow (Y), magenta (M), cyan (C), and black (K), with a toner concentration of about 2–3% solid, is provided in the toner reservoirs 55, 57, 59, and 61. Of course, in the case of a system developing a single color, such as black, only one developer is required. In order to prepare a developer for each color, the developer supplying unit fabricates a developer with a corresponding concentration by supplying the concentrated developer and the pure solvent from the concentration cartridges 82 and 84 and the solvent cartridge 86 to the toner reservoirs 55, 57, 59, and 61, respectively. For this purpose, each of the toner reservoirs 55, 57, 59, and 61 measures the concentration of the developer that is mixed according to a concentration sensor (not shown). Likewise, when the developer is prepared, the development operation begins. First, the photoconductor charging apparatus 14 charges the photoconductive drum 10 to a predetermined potential. In this state, the imaging apparatus 16 scans light on the charged photoconductive drum 10 to form an electrostatic latent image of a desired image. Subsequently, the pumps 90, 92, 94, and 96 operate such that the developer provided in the toner reservoirs 55, 57, 59, and 61 is supplied between the development roller 38 and the photoconductive drum 10 through the multicolor liquid developer spray assembly 20, thereby forming the electrostatic latent image. The developed image is transferred to the intermediate transfer member 30 and is printed directly onto the paper 72 if the developed image is formed of only one color. However, if a color image is implemented by overlapping a developer having a plurality of colors, the charge, exposure, and development operations are repeated for each of the colors. For example, if there are four colors, such as yellow (Y), magenta (M), cyan (C), and black (K), the developed image for each color is overlapped on the intermediate transfer member 30. The overlapped color image is printed onto the paper 72 passing through a space between the intermediate transfer member 30 and an impression roller 71.

However, the structure of the system in the operations from preparing the developer to supplying and collecting the developer is considerably complicated. For this reason, a concentrated high-concentration developer cannot be directly used in the development operation, and instead a low-concentration developer (less than 3% solid) is used in the development operation. Of course, if the developer with a low concentration is used, mobility is improved, and thus a difference in density of toner throughout the image is reduced. However, as described above, the concentrated developer and solvent are in each of the cartridges 82, 84, and 86, are sent to the toner reservoirs 55, 57, 59, and 61, and mixed with a developer with a low concentration, and thus an electrostatic latent image is developed with the developer having a low concentration. Then, the solvent contained in the developed image is squeezed and collected so that the developer has a high concentration suitable for printing. To make things worse, the size and cost of embedded devices further amplify the problems of this complicated structure.

Thus, in order to solve these problems, a new image developing system is required.

SUMMARY OF THE INVENTION

Accordingly, it is an object of the present invention to provide a liquid image developing system having an improved structure in which a high-concentration developer is smoothly used in a development operation without requiring squeezing.

Additional objects and advantages of the invention will be set forth in part in the description which follows and, in part, will be obvious from the description, or may be learned by practice of the invention.

The foregoing and other objects of the present invention are achieved by providing a liquid image developing system, including a cartridge in which a developer is stored; a supply line; a development container to which the developer is supplied from the cartridge through the supply line; a photosensitive body in the development container; a development roller partially soaked in the developer in the development container and rotating opposite to the photosensitive body; a depositing member to create a potential difference required to attach the developer to a circumference of the development roller, opposite to the development roller; a metering blade to scratch the developer attached to the circumference of the development roller to a predetermined thickness; and an agitator to agitate the developer contained in the development container.

According to an aspect of the present invention, the agitator includes a shaft installed to rotate adjacent to the development roller and to the depositing member; a hollow defined within the shaft and connected to the supply line; and a cross-wing mounted on the shaft and defining nozzles therein to externally connect with the hollow, wherein the cross-wing agitates the developer while rotating with the shaft, and the developer is ejected through the nozzles into a space between the depositing member and the development roller.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
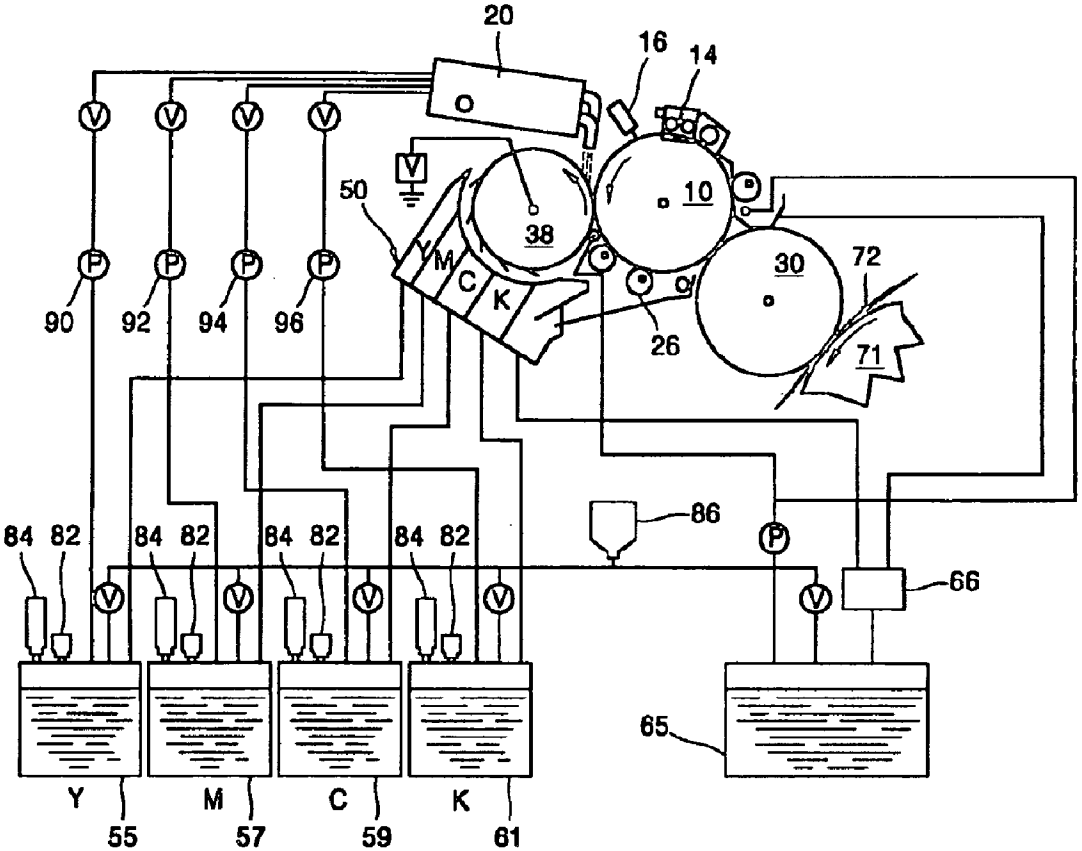
FIG. 1 (PRIOR ART)
FIG. 1 illustrates a conventional image developing system.

Reference will now be made in detail to the present preferred embodiments of the present invention, examples of which are illustrated in the accompanying drawings, wherein like reference numerals refer to like elements throughout.

Figure 2:
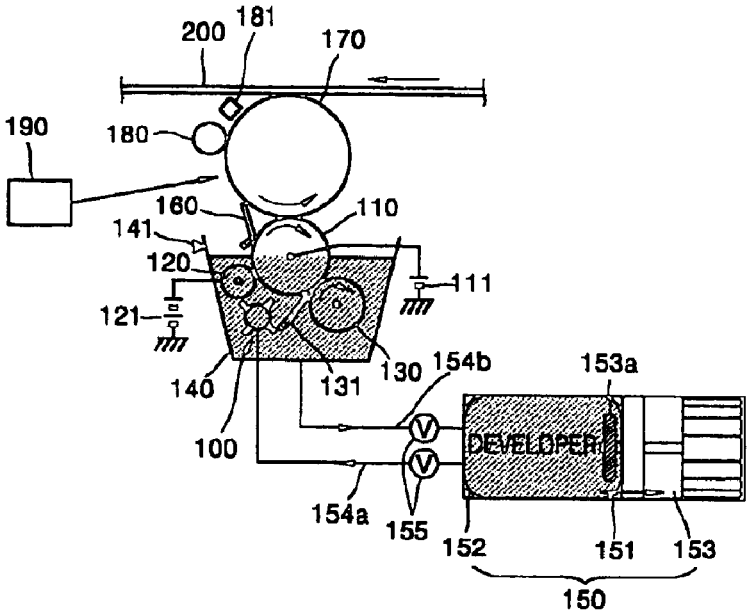
FIG. 2 illustrates a liquid image developing system according to an embodiment of the present invention.

FIG. 2 illustrates a liquid image developing system according to an embodiment of the present invention. As shown in FIG. 2, the liquid image developing system includes a cartridge 150 in which a developer is stored, and a development container 140 to which the developer is supplied from the cartridge 150. High concentration developer having a concentration of about 3–40% solid is used as the developer supplied to the development container 140 from the cartridge 150. The cartridge 150 includes a case 151, a tube 152 built in the case 151, in which the developer is contained, and a piston 153 with one side 153*a* attached to the tube 152, to perform a reciprocating movement in the case 151 and selectively compress and expand the tube 152. Thus, if the piston 153 compresses the tube 152, the developer in the tube 152 is supplied to the development container 140 through a supply line 154*a*. In the opposite case, if the piston 153 expands the tube 152, the developer contained in the development container 140 is absorbed into the tube 152 through a collection line 154*b*.

Within the development container 140 there is a development roller 110 which is partially soaked in the developer and rotates opposite to a photosensitive body 170, a metering blade 160 to scratch the developer stained on the circumference of the development roller 110 to a predetermined thickness, a depositing portion to apply an electric potential to attach the developer to the surface of the development roller 110, a cleaning portion to clean the surface of the development roller 110, and an agitator 100 to agitate the developer.

The depositing portion includes a depositing roller 120 to contact the development roller 110, and a depositing power supply part 121 to apply a voltage to the depositing roller 120. The cleaning portion includes a cleaning roller 130 to rotate to contact the development roller 110, and a cleaning blade 131 with one end contacting the surface of the development roller 110. The depositing roller 120 may be formed of a stainless material and attaches the developer to the development roller 110 by an electric force due to a voltage applied from the depositing power supply part 121, while being soaked in the developer. In this case, the depositing roller 120 may contact the development roller 110 or may be spaced at a distance of about 50–200 $\mu$m (for example, 50–100 $\mu$m) apart from the development roller 110. The depositing roller 120 may be a fixed roller or a rotating roller or may have a plate shape having a curvature similar to the circumference of the development roller 110. The cleaning roller 130, having a porous surface, rotates to contact the development roller 110 and cleans toner particles of the developer that are not developed. The development roller 110 may be formed of polyurethane rubber or NBR as a conductive elastomer, having a resistance of about 105 to about 108 ohms, a hardness of shore A 25–65 degrees, and surface roughness of Ra 1–4 $\mu$m.

Figure 3:
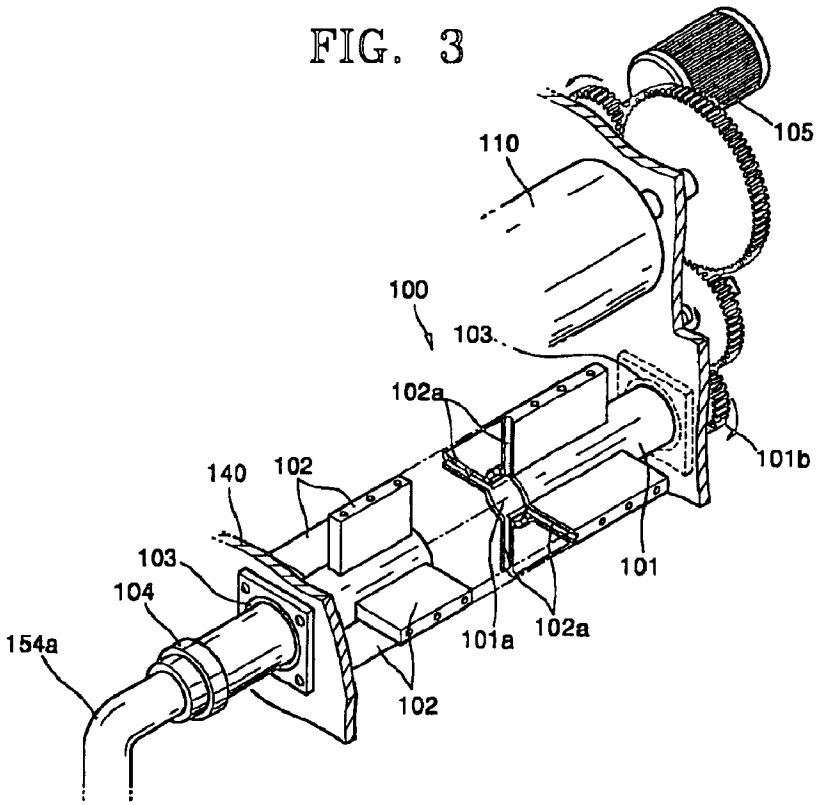
FIG. 3 illustrates the agitator shown in FIG. 2.

The agitator 100 is installed to rotate adjacent to the development roller 110 and the depositing roller 120 and agitates the developer so that the deposition of toner of the developer is prevented, the concentration of the developer is uniform, and a sufficient amount of the developer is supplied to a depositing nip between the development roller 110 and the depositing roller 120. For this purpose, as shown in FIG. 3, the agitator 100 includes a shaft 101 supported by a bearing 103 and installed to rotate in the development container 140, the shaft 101 having a hollow 101*a*, and a cross-wing 102 mounted on the shaft 101. A gear 101*b* is mounted to one end of the shaft 101, and when the gear 101*b* is actuated by a gear train via a motor 105, the other end of the shaft 101 is connected to the supply line 154*a* through a rotary joint 104 so that the developer is supplied to the hollow 101*a*. The motor 105 may be separately used only for the agitator 100. However, as shown in the drawing, the motor 105, via a gear train, also drives the development roller 110 so as to reduce the number of motors. A plurality of nozzles 102*a* communicating with the hollow 101*a* are formed in the cross-wing 102. The developer supplied to the hollow 101*a* through the supply line 154*a* is ejected into the development container 140 through the nozzles 102*a*. In such a case, the ejection pressure of the mixture is determined by the piston 153 and centrifugal force caused by the rotation of the shaft 101. The ejection pressure is approximately 5–20 bar. As an example, if the diameter of the agitator 100 is 9–15 mm at the area where the cross-wing 102 is placed, the diameter of the hollow 101*a* is 3–6 mm, and the diameter of the nozzles 102*a* is between 0.5–0.7 mm. The gear ratio to supply power between the development roller 110 and the agitator 100 is set such that the agitator 100 rotates at a speed of about 3–5 times higher than the development roller 110 and in the same direction as the development roller 110. When the agitator 100 rotates, the developer in the development container 140 is first agitated, and maintained at a uniform concentration, and is then pushed into the depositing nip by a strong ejection pressure. This allows a sufficient amount of the developer to effectively attach to the development roller 110 even when the developer with a concentration of about 3–6% solid in a comparatively low region among high-concentration regions is used.

In FIG. 2, reference numeral 111 denotes a development power supply part to apply a development voltage to the development roller 110, and reference numeral 200 denotes a transfer belt to transfer the image developed on the photosensitive body 170 and to print the transferred image onto the paper. In addition, reference numeral 180 denotes a charging roller to charge the photosensitive body 170, and reference numeral 190 denotes a laser scanning unit to scan light on the photosensitive body 170 and form an electrostatic latent image thereon.

In addition, reference numerals 181, 141, and 155 denote an eraser, a level sensor, and a valve, respectively.

Figure 4:
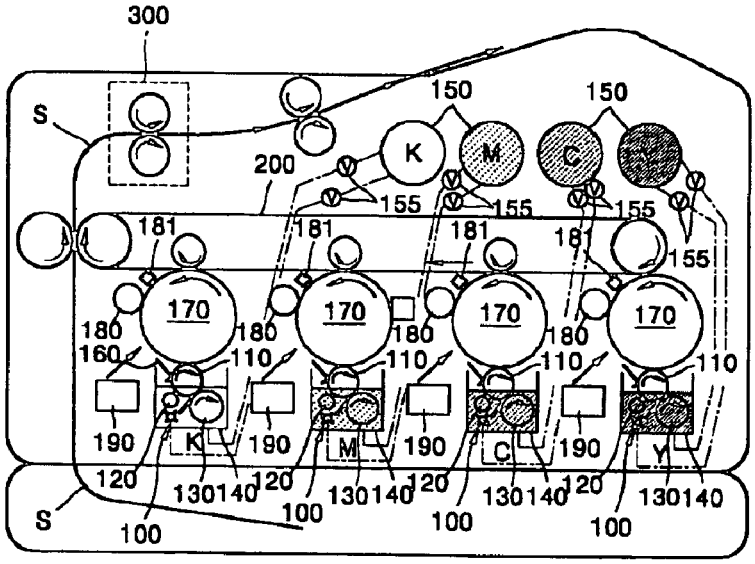
FIG. 4 schematically illustrates the structure of the image developing system of FIG. 2.

Only one developing system is provided in the image forming device using a single color, but as shown in FIG. 4, the above-mentioned developing system is also used in a color image forming device to overlap and print a plurality of colors.

In the structure of FIG. 4, in order to perform a development operation, the corresponding cartridge 150 supplies the developer for each color to the development container 140, via the supply line 154*a*, and to the agitator 100 to charge the developer to a predetermined level. As described above, the charged developer is a high-concentration developer with a concentration of about 3–40% solid (for example, 3–12% solid). After the developer reaches this concentration, the development operation begins. First, bias voltages of about 300–550 V and about 500–1550 V are applied to the development roller 110 and to the depositing roller 120, respectively. The bias voltage applied to the development roller 110 lies between a voltage of about 900 V applied to the photosensitive body 170 (charging body) by the charging roller 180 and a voltage of about 100 V applied to a portion in which an electrostatic latent image is formed by the laser scanning unit 190. If the bias voltage is applied to the development roller 110 in this way, toner particles of the developer are positively charged, and thus attach to the surface of the development roller 110 by a voltage difference between the development roller 110 and the depositing roller 120. Of course, since the voltages applied to the depositing roller 120 and to the development roller 110, respectively, are positive, the positively charged toner particles may be pushed out from the development nip. However, since the agitator 100 pushes the developer into the depositing nip through the nozzles 102*a* while rotating, a sufficient amount of toner particles are always supplied to the depositing nip.

Toner particles may electrically strongly or weakly attach to the development roller 110 through the depositing nip. According to experiment, the concentration of the developer attached to the development roller 110 by an electric force before passing the metering blade 160 when the developer with a concentration of about 3–12% solid is used, is 6–14% solid with a mass/area (M/A) of 400–1100 $\mu g/cm^2$. When a developer with a concentration of 3% solid, which is a relatively low concentration, is used, the concentration of the development roller 110 is 6% solid, twice as much as the initial concentration. When a developer with a concentration of 12% solid is used, the concentration of the development roller 110 slightly increased to 12–14% solid. However, before passing the metering blade 160, a concentration difference of the developer is large, and thus it is difficult to develop an image with a uniform concentration if the electrostatic latent image formed on the photosensitive body 170 is developed without changing.

Afterwards, the developer stained on the development roller 110 is scratched by the metering blade 160 to a predetermined and uniform thickness. In order to form the metering blade 160, a metal plate having a thickness of 0.05–2 mm is formed in an L-shape so that a curved portion contacts the development roller 110 on the surface of the developer. However, if the metering blade 160 scratches the developer closely attached to the development roller 110 and stained on the surface of the development roller 110, various modifications are possible. For example, a voltage may be applied to the metering blade 160, and pressure, contact position, and the shape of a contact portion of the development roller 110 may be modified. Of course, under the above conditions, the M/A left on the surface of the development roller 110 before the development operation gradually varies. When the developer with a concentration of about 3–40% solid is used, and these conditions are slightly changed, the M/A on the development roller 110 before the development operation is about 150–500 $\mu g/cm^2$, thereby a relative uniform concentration is achieved. In particular, when the developer with a concentration of about 3–12% solid is used, the M/A of the developer stained on the development roller 110 after passing through the depositing roller 120 was 413–1126 $\mu g/cm^2$, and the M/A of the developer stained on the development roller 110 before the development operation after passing through the metering blade 160 is 180–220 $\mu g/cm^2$, showing a considerably uniform distribution. In this case, the distance between the depositing roller 120 and the development roller 110 is about 70–100 $\mu m$, and the voltage difference between the development roller 110 and the depositing roller 120 is 500 V. Thus, the concentration of the developer before the development operation can be maintained uniform and the developer can be used in the development operation even though a developer within a wider range of a concentration, i.e., 3–12% solid, is used. This is the reason a sufficient amount of the toner is always supplied to the depositing nip by the agitator 100 even though the toner has a comparatively low concentration, and the distribution of the concentration of the toner is uniform before the development operation using the metering blade 160.

Subsequently, contact development is performed on the photosensitive body 170 using the development roller 110 on which the developer with the above concentration is stained. In such a case, as described above, the potential of the charged photosensitive body 170 is 900 V, the potential of a portion in which the electrostatic latent image is formed is 100 V, and the moving speed of the transfer belt 200 is 3.0 inch/sec. For these values, the M/A of the development roller 110 before the development operation is 180–220 $\mu g/cm^2$. Under these conditions, the concentration of an image in an image region in which the electrostatic latent image on the photosensitive body 170 is formed is M/A 200

$\mu g/cm^2$. In the image portion, the optical density (OD) is about 1.3–1.4,thus a good development efficiency is achieved. In the non-image portion, the optical density (OD) of less than 0.03 is measured, therefore there is less contamination in the non-image portion. Furthermore, the concentration of the developer of the image developed on the photosensitive body 170 is high (greater than 25% solid) without the flow of excess solvent. Since a state suitable for transfer has been already formed even if a squeezing operation is not performed, an additional squeezing operation is not necessary. The toner particles left on the development roller 110 after the development operation are removed by the cleaning roller 130 and the cleaning blade 131, which are soaked in the development container 140.

The developed image is transferred onto the transfer belt 200, and if the developed image is formed of only one color, the developed image is printed directly onto the paper S. However, in the case of implementing a color image, each image developed by each developing system for four colors, such as yellow (Y), cyan (C), magenta (M), and black (K), is overlapped on the transfer belt 200, and then is printed onto the paper S. Then, the paper S passes through a fusing unit 300, is heated, impressed, and exhausted.

In the image developing system, the high-concentration developer can be directly used in the development operation without a dilution operation, and thus the structure to supply the developer can be considerably simplified, and the squeezing operation of squeezing excess solvent can be omitted. In addition, the developer stained on the development roller in the development operation can be maintained at a uniform concentration using the agitator 100 and the metering blade 131, thereby achieving a very efficient system.

As described above, the liquid image developing system according to the present invention has the following advantages. First, since the high-concentration developer put in the cartridge is supplied directly to the development container without an additional dilution operation to perform the development operation, the structure to supply the developer can be simplified, and thus the overall size of the printer can be reduced.

Second, using the agitator and the metering blade, the distribution of the concentration of the developer in the development container and the concentration of the developer on the development roller can be uniform, and thus a controller to dilute the developer and adjust the concentration of the developer is not required.

Third, as the concentration of the developer is increased, the spread of the image is reduced, thereby achieving a high quality image capable of preventing the contamination of the non-image portion.

Fourth, by performing the development operation using the high-concentration developer, a squeezing operation can be omitted.

Fifth, due to the omission of the squeezing operation, dwell time can be reduced, thereby performing printing work at a higher speed.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A liquid image developing system, comprising:

a cartridge in which a developer is stored;

a supply line;

a development container to which the developer is supplied from the cartridge through the supply line;

a photosensitive body;

a development roller partially soaked in the developer in the development container and rotating opposite to the photosensitive body;

a depositing member to create a potential difference to attach the developer to a circumference of the development roller, opposite to the development roller;

a metering blade to scratch the developer attached to the circumference of the development roller to a predetermined thickness; and an agitator to agitate the developer contained in the development container.

2. The system of claim 1, wherein the agitator comprises:

a shaft to rotate adjacent to the development roller and the depositing member;

a hollow defined within the shaft and connected to the supply line; and a cross-wing mounted on the shaft and defining nozzles therein to externally connect with the hollow, wherein the cross-wing agitates the developer while rotating with the shaft, and the developer is ejected through the nozzles into a space between the depositing member and the development roller.

3. The system of claim 1, wherein the cartridge comprises:

a case;

a tube to contain the developer; and a piston with a side attached to the tube, the piston performing a reciprocating movement in the case and selectively compressing and expanding the tube.

4. The system of claim 1, further comprising a cleaning portion to clean a surface of the development roller.

5. The system of claim 4, wherein the cleaning portion comprises:

a cleaning roller to rotate and to contact the development roller; and a cleaning blade having an end to contact the surface of the development roller.

6. The system of claim 1, wherein a concentration of the developer is 3–40% solid.

7. The system of claim 1, further comprising:

a collection line, separate from the supply line, to supply the developer from the development container to the cartridge.

8. A liquid image developing system, comprising:

a container to contain a developer having a concentration of 3–40% solid;

an agitator to agitate the developer;

a development roller partially soaked in the developer contained in the container, the developer being attached to the development roller;

a photosensitive body to receive the developer attached to the development roller;

a depositing member to create a potential difference on the development roller to attach the developer to a circumference of the development roller, wherein the developer is directly attached to the development roller without a dilution operation;

a metering blade to scratch the developer attached to the circumference of the development roller to a predetermined thickness;

a cartridge in which the developer is stored; and a supply line to supply the developer from the cartridge to the container, wherein the agitator comprises:

a shaft to rotate adjacent to the development roller and the depositing member;

a hollow defined within the shaft and connected to the supply line, and a cross-wing mounted on the shaft and defining nozzles therein to externally connect with the hollow, wherein the cross-wing agitates the developer while rotating with the shaft, and the developer is ejected through the nozzles into a space between the depositing member and the development roller.

9. A liquid image developing system, comprising:

a container to contain a developer;

a development roller partially soaked in the developer contained in the container;

an agitator to agitate the developer, wherein the agitator comprises:

a shaft, a hollow being defined therein, and a cross-wing mounted on the shaft and defining a nozzle therein to connect with the hollow; and a photosensitive body to receive the developer from the development roller.

10. A method of developing an image, comprising:

agitating a developer having a concentration of 3–40% solid and supplying the agitated developer to a development roller;

partially soaking the development roller in the developer;

applying a first voltage to the development roller to thereby attach the developer to the development roller;

contacting the development roller with a depositing roller; and applying a second voltage to the depositing roller, the first and second voltages having a same polarity.

11. The method of claim 10, further comprising:

attaching a portion of the developer attached to the development roller to a photosensitive body; and removing a portion of the developer not attached to the photosensitive body from the development roller.

12. The method of claim 11, wherein the removing comprises scratching the developer not attached to the photosensitive body from the development roller.

13. The method of claim 10, wherein a nip is formed between the development roller and the depositing roller.

14. A liquid image developing system, comprising:

a development roller;

a depositing roller to apply developer to the development roller; and a rotating nozzle to supply the developer between the development roller and the depositing roller.

* * * * *